US008129967B2

(12) United States Patent
Blisson et al.

(10) Patent No.: US 8,129,967 B2
(45) Date of Patent: Mar. 6, 2012

(54) VOLTAGE REGULATOR WITH SELF-ADAPTIVE LOOP

(75) Inventors: Fabrice Blisson, Grenoble (FR); Jean-Luc Moro, Le Sappey En Chartreuse (FR); Marc Sabut, Eybens (FR)

(73) Assignee: STMicroelectronics S.A., Montrouge (FR)

( * ) Notice: Subject to any disclaimer, the term of this patent is extended or adjusted under 35 U.S.C. 154(b) by 653 days.

(21) Appl. No.: 12/334,996

(22) Filed: Dec. 15, 2008

(65) Prior Publication Data

US 2009/0184702 A1 Jul. 23, 2009

(30) Foreign Application Priority Data

Dec. 17, 2007 (FR) ..... 07 59908

(51) Int. Cl.
*G05F 1/00* (2006.01)

(52) U.S. Cl. ..... 323/280; 323/226

(58) Field of Classification Search ..... 323/273–281, 323/226, 269, 270, 315, 313
See application file for complete search history.

(56) References Cited

U.S. PATENT DOCUMENTS

2003/0218454 A1 11/2003 Cunnac et al.
2006/0055383 A1 3/2006 Eberlein
2006/0164053 A1 7/2006 Walter et al.
2007/0188228 A1 8/2007 Renous
2007/0216472 A1 9/2007 Gicquel et al.

FOREIGN PATENT DOCUMENTS

FR 2 881 236 A1 7/2006

OTHER PUBLICATIONS

Gupta, et al., "A Low Dropout, CMOS Regulator with High PSR over Wideband Frequencies," Circuits and Systems, 2005, ISCAS 2005; IEEE International Symposium O N Kobe, Japan May 23-26, 2005; Piscataway, NJ, USA, IEEE, May 23, 2005; pp. 4245-4248, XP010816610; ISBN: 978-0-7803-8834-5.
Preliminary French Search Report and Written Opinion, FR 07 59908, dated Nov. 28, 2008.

*Primary Examiner* — Harry Behm
*Assistant Examiner* — Matthew Grubb
(74) *Attorney, Agent, or Firm* — Gardere Wynne & Sewell LLP

(57) ABSTRACT

A voltage regulator includes an amplifier and a regulation loop. The regulator includes a first PMOS transistor connected to a terminal supplying an input voltage, a second PMOS transistor connected in series with the first PMOS transistor. A node between those two transistors defines an output terminal. A first source of a first polarization current of fixed value is connected to the gate of the first transistor, and a second source of a second polarization current of fixed value connects the second transistor to ground. A third NMOS transistor is connected between the two current sources. A circuit is provided to modify automatically at least one of the polarization currents in relation to the load current.

22 Claims, 3 Drawing Sheets

VOLTAGE REGULATOR WITH SELF-ADAPTIVE LOOP

PRIORITY CLAIM

This application is a translation of and claims priority from French Application for Patent No. 07 59908 of the same title filed Dec. 17, 2007, the disclosure of which is hereby incorporated by reference.

BACKGROUND OF THE INVENTION

1. Technical Field of the Invention

The present invention concerns the area of voltage generation circuits, in particular voltage regulators (for example, those included in integrated circuits in the form of an electronic chip).

2. Description of Related Art

Some chips have analog blocks and digital blocks supplied by respective different voltages, e.g. 2.5 V for analog blocks and 1.2 V for digital blocks.

In such cases, it is therefore possible to use part of the voltage supply for the analog blocks to supply a digital or analog block, making it possible for example to eliminate the need to have recourse to a switching power supply.

For this purpose, voltage generators are used, in the present case regulators, which must be capable of meeting consumption peaks corresponding to demands for current from digital blocks when these come into operation.

A conventional regulator R is illustrated FIG. 1*a*. The regulator R comprises an amplifier with a feedback loop, and an output power PMOS transistor (Pout) which supplies an external capacitor (Cext) acting as load ballast towards the digital or analog load (DL).

When the digital or analog block is in operation, this implies peak current consumption on the output line (Vout). If the peak is low, the current is supplied by the external capacitor (Cext), and if the peak is high or lasts a certain time, the external capacitor discharges and the loop 1 allows action from the output (Vout) on the amplifier input so as to lower the gate of the power transistor (Pout) to restore current.

However, said circuit is relatively slow, and incompatible with current response time needs, which are in the order of a few nanoseconds.

Additionally, load quantity can raise a problem. For example, whereas the standby current on the output line (Vout) may be 1 mA, the current demanded by a load may be 100 mA. A circuit such as shown FIG. 1*a* cannot meet said demand, since it is not fast enough. Said circuits are not adapted for pulse responses, i.e. their output voltage (Vout) may drop further to demand for current from the digital or analog block.

To overcome these disadvantages, reference is made to French Application for Patent No. 2881236 (the disclosure of which is hereby incorporated by reference). FIG. 1*b* illustrates a circuit for the production of reference voltages to supply an analog/digital converter.

In this configuration, the output is looped back to the input of the amplifier, so that the output (Vout) is servo-controlled by the reference voltage (Vref) in the form of a slow loop as mentioned above. The reference FR 2881236 also proposes a fast loop 1', at an output stage of the amplifier.

In FIG. 1*b*, the output stage is magnified and shown in dashed lines. The gate of the PMOS transistor M2 is fixed by the slow loop, and allows a low impedance node to be obtained.

When the digital or analog block makes a demand for current, the source of the PMOS transistor M2 decreases, and the transistor cuts off. Yet, since the current source I0 is constant (as is current source I1), more current circulates through the NMOS transistor M3 (whose gate is at a fixed voltage VB) acting on the gate of the PMOS power transistor M1, whose gate voltage decreases rapidly, allowing current to be supplied to the digital or analog block.

The group of transistors M1, M2 and M3 defines the fast loop 1', which can provide very fast response times, typically in the order of a few nanoseconds, between the load current demand (IL) and the response of the power transistor M1.

It is true that the above-described circuit is adapted for the supply of an analog/digital converter, whose consumption magnitude is in the order of a factor of 20 to 50 (a few dozen microamperes), yet it is not optimal for use with a regulator whose consumption is in the order of factor one thousand.

Additionally, the load of the digital or analog block is not always known.

There is a need to overcome these drawbacks.

SUMMARY OF THE INVENTION

According to an embodiment, a circuit, for example a voltage regulator, is configured to supply an output voltage at an output terminal which can be connected to the supply of at least one digital or analog block, which may consume a load current. The circuit comprises an amplifier and a regulation loop, called a fast loop, connected to the output of the amplifier, said regulation loop comprising: a first PMOS transistor connected to a first terminal applying an input supply voltage, a second PMOS transistor controlled by the amplifier and mounted in series with the first PMOS transistor, their midpoint defining the output terminal supplying the output voltage, a first source of a first polarization current of fixed value connecting said first supply terminal to the gate of the first transistor, a second source of a second polarization current of fixed value connecting the second transistor to ground, and a third NMOS transistor, connecting the two current sources.

In the embodiment, the circuit further comprises means to modify automatically at least one of the polarization currents in relation to the load current.

According to another embodiment, an electronic chip comprises at least one circuit and or regulator according to the foregoing description.

In an embodiment, a circuit comprises: a first MOS transistor having a first gate terminal and a first conduction terminal; a second MOS transistor having a second gate terminal and a second and third conduction terminals; a node between the first and second conduction terminals which forms an output of the circuit; a third MOS transistor coupled between the first gate terminal and the third conduction terminal; a first current source for sourcing current to the first gate terminal; a second current source for sinking current from the third conduction terminal; and a bypass capacitor coupled between the output node and the third conduction terminal.

In an embodiment, a circuit comprises: a first MOS transistor having a first gate terminal and a first conduction terminal; a second MOS transistor having a second gate terminal and a second and third conduction terminals; a node between the first and second conduction terminals which forms an output of the circuit; a third MOS transistor coupled between the first gate terminal and the third conduction terminal; a first current source for sourcing current to the first gate terminal; a second current source for sinking current from the third conduction terminal; and a supplementary circuit which responds to changes in desired load current at the output node by supplying additional current to the current sourced by the first current source and sinking additional current to the current sunk by the second current source.

BRIEF DESCRIPTION OF THE DRAWINGS

Other characteristics and advantages will become more clearly apparent on reading the following description given by way of illustrative example and non-limiting, given with reference to the appended drawings in which.

DETAILED DESCRIPTION OF THE DRAWINGS

Figure 1A:
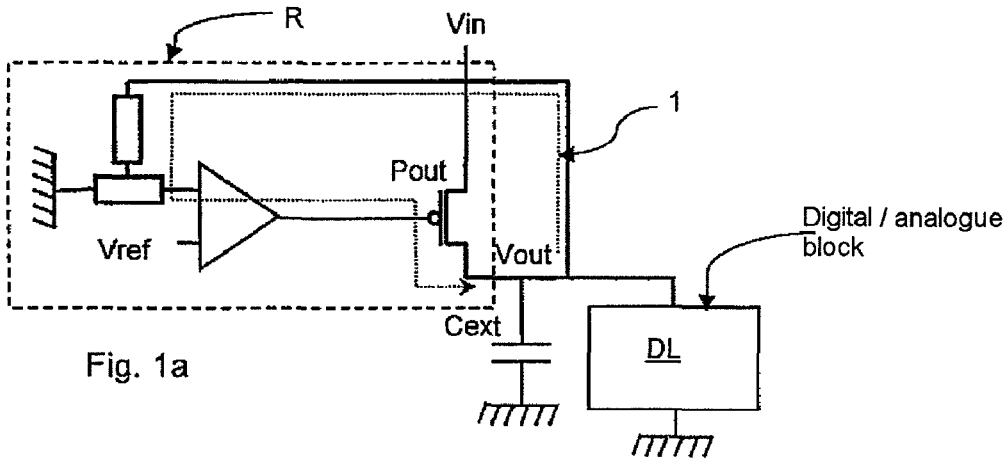
FIG. 1*a* illustrates a circuit generating a reference voltage according to the prior art.
Figure 1B:
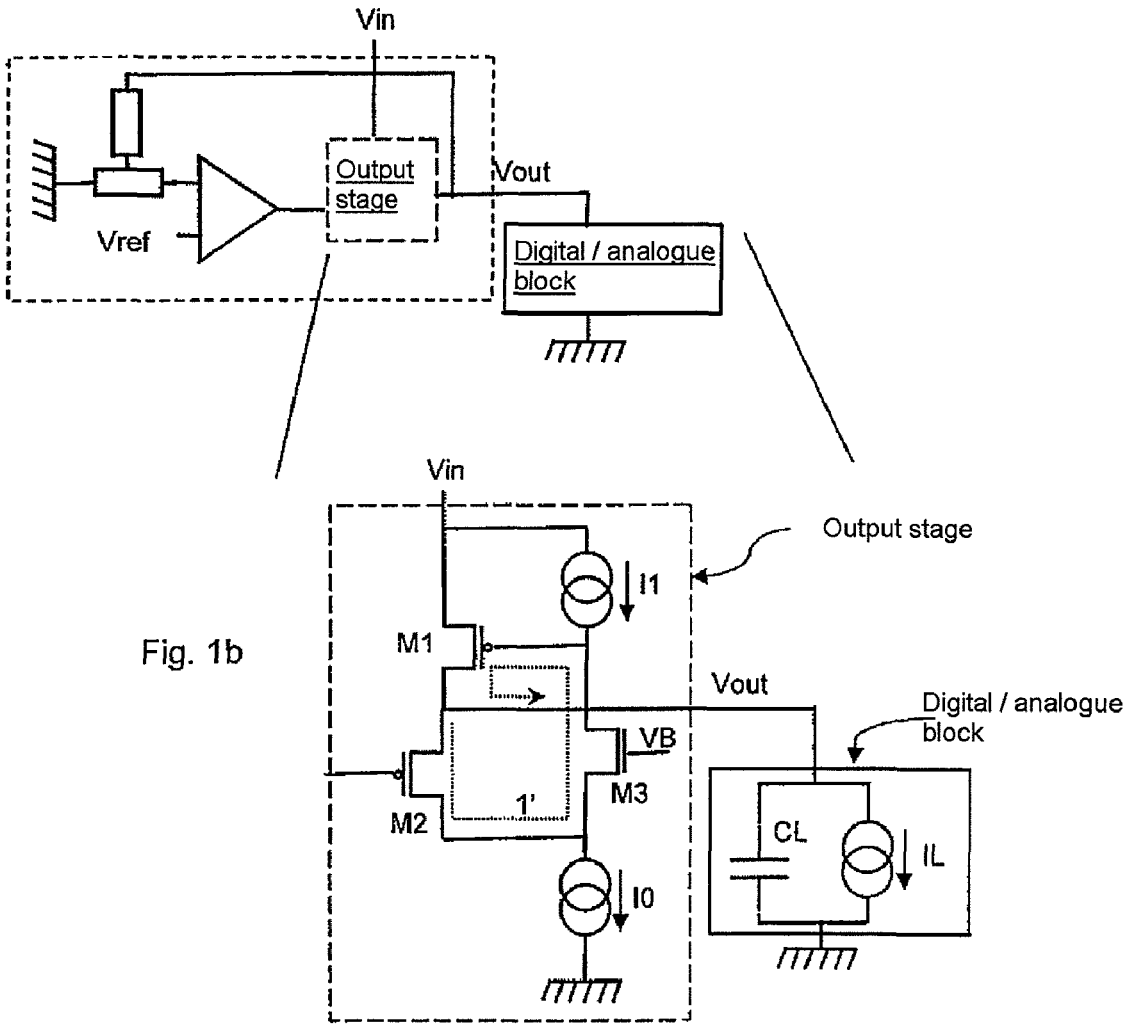
FIG. 1*b* illustrates another circuit generating a reference voltage according to the prior art.

FIGS. 1*a* and 1*b* have already been described.

Figure 2:
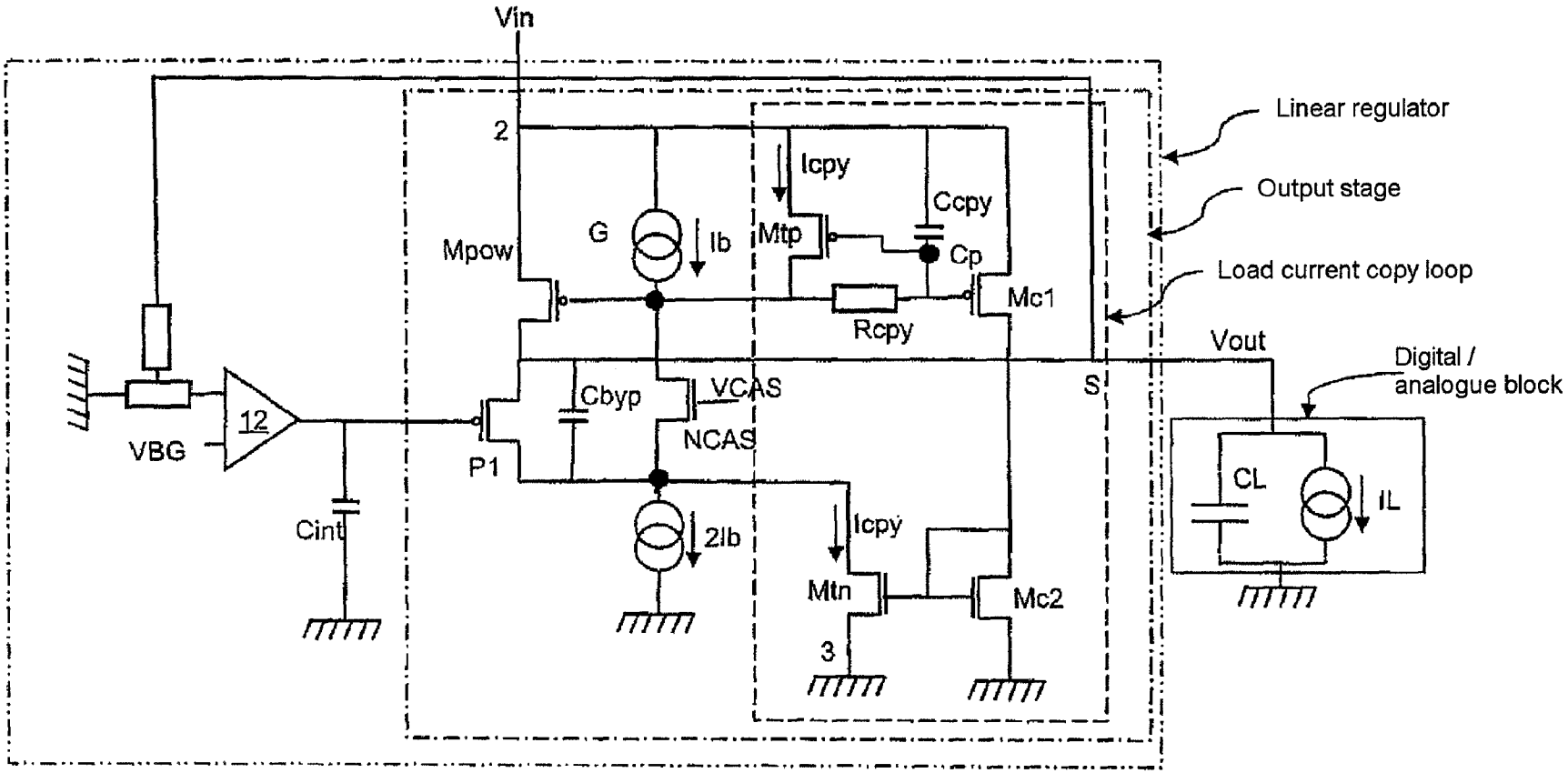
FIG. 2 illustrates a voltage regulator according to an embodiment.

An embodiment is shown in FIG. 2, which (like in FIG. 1*b*) comprises an output stage connected as in a node C of an amplifier 12.

The amplifier 12 is connected at the input to a voltage source VBG (band-gap) to drive the gate of the PMOS transistor P1.

As in FIG. 1*b*, FIG. 2 illustrates a fast loop comprising a first PMOS transistor Mpow, called a power transistor, connected to a first terminal 2 applying an input supply voltage Vin, a second PMOS transistor P1 controlled by the amplifier 12 and mounted in series with the first PMOS transistor Mpow, their mid-point defining the output terminal S supplying the output voltage Vout.

The fast loop also comprises a third NMOS transistor NACS connected between two current sources Ib, 2Ib, such that the first source of a first polarization current Ib of fixed value connects said first supply terminal 2 to the gate of the first transistor Mpow, and the second source of a second polarization current 2Ib of fixed value connects the second transistor P1 to ground 3.

As in FIG. 1*b*, the implementation of FIG. 2 also comprises a slow loop. That is to say that the output node S at the output voltage Vout is fed back onto the second input of the amplifier 12.

Therefore, when the digital or analog block requests current, the amplifier tends to equalize its two inputs by acting on the gate of transistor P1. Therefore Vout=VBG to the gain of the amplifier. And the variation in the gate-source voltage Vgs of the power transistor Mpow allows a current variation to be generated of the power current Ipow, hence of the load current IL.

As seen previously, when the load current peaks, the fast loop reacts whereas the slow loop does not.

Advantageously, the fast loop comprising the Mpow, P1 and NCAS transistors also comprises a bypass capacitor Cbyp in parallel with the second PMOS transistor P1, allowing direct action on the source of the NCAS transistor when the output voltage falls rapidly (load current demand).

However, the gate of the NCAS transistor is at a fixed reference voltage VCAS, therefore when the voltage at its source decreases, it draws strongly on the voltage at the gate of the power transistor Mpow, which allows only two transistors (Mpow, NCAS) to be crossed in the fast loop.

A digital or analog block can achieve different functions and can consist of a greater or lesser number of components, themselves of greater or lesser complexity, i.e. consuming current, whose load capacitance CL to be supplied may vary from a few pF to a few nF.

The circuit of FIG. 2 sets out to provide a voltage regulator irrespective of the type of digital or analog block, i.e. capable of meeting a factor in the order of one thousand on the capacitive load CL. Also, a factor in the order of one thousand may exist on the load current IL between a standby state and a consumption state.

Yet the current in the circuit of FIG. 2 is fixed by the sources of polarization currents Ib, 2Ib. And for a given polarization current Ib, the fast loop (as in FIG. 1*b* or FIG. 2) is capable of supplying in the order of 20*Ib to 50*Ib.

On the other hand, if the load current IL is too high, the NCAS transistor is pinched and the fast loop no longer functions.

The circuit of FIG. 2 provides a solution to this problem by adapting the current of the fast loop Ipow, Ib, 2Ib to the load current IL self-adaptively.

The current consumption of a digital or analog block corresponds to a mean current about which there are a certain number of peaks. The circuit of FIG. 2 enables the regulator to adapt to the mean load current so that it is able to supply the consumption peaks.

For this purpose, one part Icpy of the Ipow current of the power transistor Mpow is copied into transistor Mc1. The sizing of the transistors is advantageously such that Icpy is substantially equal to a given fraction of Ipow, in this case 1%.

The transistor Mtn lies parallel with the second source of the second polarization current 21*b*, and allows the latter to be increased.

Similarly, the transistor Mtp lies parallel with the first source of the first polarization current Ib, and allows the latter to be increased. The current copied by Mtp is directly added to Ib in parallel.

The transistors Mtp and McI have current mirror assembly relative to the power transistor Mpow of which they each copy 1% of the Ipow current by means of their sizing that is proportional to that of the power transistor Mpow.

The current copied by Mc1 enters into a current mirror unit (IMtn=IMc2) formed by Mc2 and Mtn.

Therefore, the current added by the transistor Mtn in parallel to the source 2Ib is equal to the current initially copied by Mc1, i.e. 1% of Ipow.

By means of these characteristics, any current consumed by the digital or analog block allows the polarization of the fast loop to be modified, while maintaining near-constant yield, in this case in the order of 99%, irrespective of the load of the digital or analog block, through the addition of the Icpy currents to the sources of fixed current Ib, 2Ib.

If there is no load current IL, the power current Ipow is equal to the polarization current Ib, as is the case for the current passing through the transistor P1.

When the digital or analog block consumes current, the gate voltage of the power transistor Mpow is decreased and the transistor then supplies a current that is higher than the polarization current Ib.

Measurement of the power current Ipow, by the copying performed by transistors Mtp and Mc1 (mirrored by transistors Mtn and Mc2), allows current to be added in parallel to sources Ib, 2Ib, so that the value of the copy current Icpy is ten times greater for example than that of the polarization current Ib.

The copy current Icpy is injected in parallel to source Ib by transistor Mtp and is absorbed by the transistor Mtn in parallel to source 21*b*, after copying by transistors Mc1 and Mc2.

Through the increase in the currents in parallel to Ib and 21*b*, the gate transconductances "gm" and the bandwidth of the transistors are increased at the same time, hence the regulator reacts more quickly and can meet load current pulses that are much stronger.

Advantageously, the regulator of the invention also comprises a low-pass filter Rcpy, Ccpy in parallel with the first current source Ib.

Therefore the node Cp follows node G corresponding to the gate of the power transistor Mpow by means of said low-pass filter, and the transistors Mtp and McI only react to low frequencies.

The low-pass filter allows the circuitry formed by Mtp, Mc1, Mtn, Mc2, Rcpy, Ccpy, to operate in order to modify automatically at least one of the polarization currents Ib, 2Ib in relation to the load current IL, but not to respond immediately to a consumption peak of the digital or analog block, and only allows the power transistor Mpow to respond immediately.

The means to modify automatically at least one of the polarization currents are effectively configured to increase the direct current in the fast loop, and are not adapted to meet consumption pulses of the digital or analog block.

Through the increase in the polarization currents, the gate of the power transistor Mpow can be controlled more rapidly by the NCAS transistor. The power transistor Mpow therefore reacts more rapidly to variations in the load current IL.

With the FIG. 2 circuit, one same regulator can be used for an unknown digital or analog block, through the copy made of the load current IL allowing its measurement. The polarization currents can therefore be adjusted automatically to an optimal value.

Advantageously, by means of the FIG. 2 circuit, the fast loop remains stable over a wide range of load currents.

Additionally, the standby current (when there is no load current) remains low and allows a good yield to be maintained.

Figure 3:
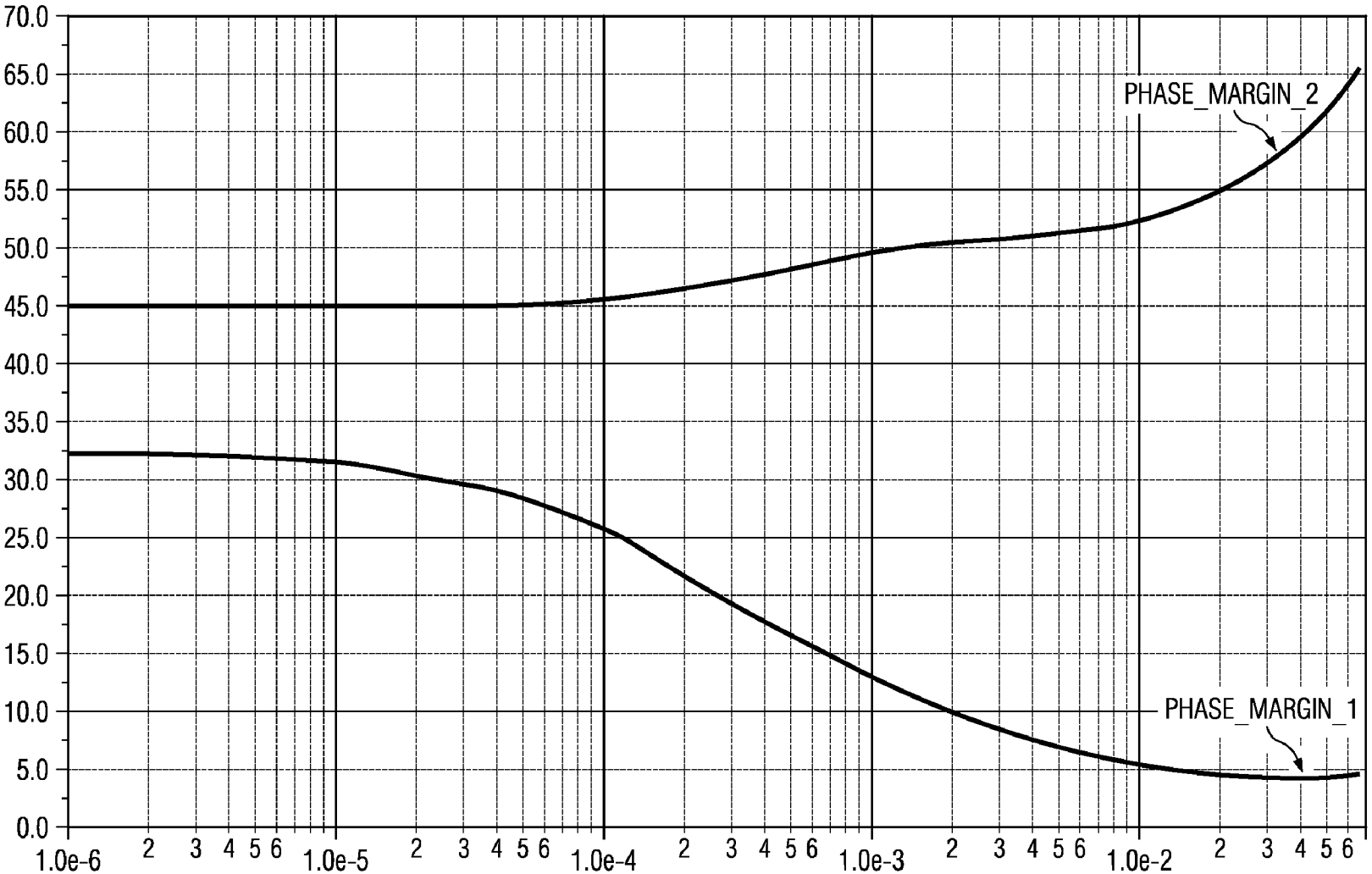
FIG. 3 illustrates the comparison of the phase margins between the embodiment of FIG. 2 and a prior art embodiment.

As shown in FIG. 3, illustrating the phase margin PHASE_MARGIN_2 of the embodiment of the regulator according to FIG. 2, and the phase margin PHASE_MARGIN_1 of the prior art shown in FIG. 1*b*, in relation to the load current and on a logarithmic scale in mA, the regulator of FIG. 2 remains stable over variations in the load current IL of three to four decades, whereas in the prior art it only remains stable over one to two decades.

Additionally, in the circuit of FIG. 2, the more the load current increases the more the phase margin increases, whereas in the prior art the more the load current increases the more the phase margin decreases.

With regard to stability, the loop defined by the transistors Mpow NCAS and the capacitor Cbyp can become unstable if the current consumed by the digital or analog block is too high.

On the other hand, the loop defined by the means to modify automatically at least one of the polarization currents in relation to the load current (Mtp, Mc1, Rcpy, Ccpy, Mtn, Mc2) is stable through its construction by means of the low-pass filter (Rcpy, Ccpy). And advantageously, this loop allows stabilization of the loop defined by the transistors Mpow, NCAS and capacitor Cbyp through the increase in the polarization currents Ib and 2Ib.

In an electronic chip comprising a regulator, a plurality of fast regulation loops can be placed in parallel at the output of the amplifier 12 to supply one same digital or analog block or several digital or analog blocks. In the case herein, each digital or analog block is surrounded by a fast regulation loop. Therefore, when a digital or analog block makes a demand for current, the source lies closest to meet this demand.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A circuit, comprising:

an amplifier; and a regulation loop connected to an output of the amplifier, said regulation loop comprising:

a first PMOS transistor, a second PMOS transistor controlled by the amplifier output and connected in series with the first PMOS transistor, a node between the first and second PMOS transistors defining an output terminal supplying an output voltage, a first source configured to supply a first polarization current of fixed value to the gate of the first PMOS transistor, a second source configured to sink a second polarization current of fixed value from the second PMOS transistor, a first NMOS transistor connected between the first and second sources, and a circuit configured to automatically modify at least one of the first and second polarization currents in relation to a load current at the output terminal.

2. The circuit according to claim 1, wherein the circuit configured to automatically modify at least one of the first and second polarization currents comprises means for copying part of a current passing through the first PMOS transistor.

3. The circuit according to claim 1, wherein the circuit configured to automatically modify comprises, with respect to the first polarization current, a third PMOS transistor connected in parallel with the first source and having a gate terminal coupled to a gate of the first PMOS transistor.

4. The circuit according to claim 3, wherein the circuit configured to automatically modify comprises, with respect to the second polarization current, comprise a second NMOS transistor connected in parallel with the second source and having a gate terminal connected to a gate terminal of a third NMOS transistor which is connected in series with a fourth PMOS transistor having a gate terminal coupled to the gate of the first PMOS transistor.

5. The circuit according to claim 4, further comprising a low-pass filter coupled in parallel with the first source.

6. The circuit according to claim 1, further comprising a bypass capacitor in parallel with the second PMOS transistor.

7. The circuit according to claim 1 further comprising at least one digital or analog block connected to the output terminal.

8. The circuit according to claim 7, further comprising a plurality of regulation loops placed in parallel at the output of the amplifier and configured to supply one same digital or analog block.

9. The circuit according to claim 8, comprising a single amplifier configured to supply a plurality of digital or analog blocks.

10. A circuit, comprising:

a first MOS transistor having a first gate terminal and a first conduction terminal;

a second MOS transistor having a second gate terminal and a second and third conduction terminals;

a node between the first and second conduction terminals which forms an output of the circuit;

a third MOS transistor coupled between the first gate terminal and the third conduction terminal;

a first current source configured to source current to the first gate terminal;

a second current source configured to sink current from the third conduction terminal;

a bypass capacitor coupled between the output node and the third conduction terminal and a low pass filter circuit comprising a resistor coupled between a first terminal and the first gate terminal of the first MOS transistor and a capacitor coupled between the first terminal and a reference voltage.

11. The circuit of claim 10 further comprising:

a first current mirror circuit formed from a first mirror transistor and a second mirror transistor sharing the first terminal as a first common control terminal which is coupled to the first gate terminal of the first MOS transistor; and a second current mirror formed from a third mirror transistor and a fourth mirror transistor sharing a second common control terminal.

12. The circuit of claim 11 wherein the first mirror transistor supplies a first mirror current to the first gate terminal and the third mirror transistor sinks a second mirror current from the third conduction terminal.

13. The circuit of claim 12 wherein the second mirror transistor and fourth mirror transistor are connected in series with each other.

14. The circuit of claim 11 wherein the low pass filter circuit is coupled to the first current mirror with the resistor coupled between the first common control terminal and a conduction terminal of the first mirror transistor and the capacitor coupled between the first common control terminal of the first and second mirror transistors and the reference voltage.

15. A circuit comprising:

a first MOS transistor having a first gate terminal and a first conduction terminal;

a second MOS transistor having a second gate terminal and a second and third conduction terminals;

a node between the first and second conduction terminals which forms an output of the Circuit;

a third MOS transistor coupled between the first gate terminal and the third conduction terminal;

a first current source configured to source current to the first gate terminal;

a second current source configured to sink current from the third conduction terminal;

a bypass capacitor coupled between the output node and the third conduction terminal;

a first current mirror circuit formed from a first mirror transistor and a second mirror transistor sharing a first common control terminal which is coupled to the first gate terminal of the first MOS transistor;

a second current mirror formed from a third mirror transistor and a fourth mirror transistor sharing a second common control terminal; and a low pass filter circuit coupled to the first current mirror;

wherein the low pass filter circuit comprises a resistor coupled between the first common control terminal and the first gate terminal of the first MOS transistor; and a capacitor coupled between the first common control terminal and a reference voltage.

16. A circuit, comprising:

a first MOS transistor having a first gate terminal and a first conduction terminal;

a second MOS transistor having a second gate terminal and a second and third conduction terminals;

a node between the first and second conduction terminals which forms an output of the circuit;

a third MOS transistor coupled between the first gate terminal and the third conduction terminal;

a first current source configured to source current to the first gate terminal;

a second current source configured to sink current from the third conduction terminal; and a supplementary circuit configured to respond to changes in desired load current at the output node by at least one of supplying additional current to the current sourced by the first current source and sinking additional current to the current sunk by the second current source.

17. The circuit of claim 16 wherein the supplementary circuit comprises:

a first current mirror circuit formed from a first mirror transistor and a second mirror transistor sharing a first common control terminal which is coupled to the first gate terminal of the first MOS transistor; and a second current mirror formed from a third mirror transistor and a fourth mirror transistor sharing a second common control terminal.

18. The circuit of claim 17 wherein the first mirror transistor is configured to supply a first mirror current to the first gate terminal and the third mirror transistor is configured to sink a second mirror current from the third conduction terminal.

19. The circuit of claim 18 wherein the second mirror transistor and fourth mirror transistor are connected in series with each other.

20. The circuit of claim 17 further comprising a low pass filter circuit coupled to the first current mirror.

21. The circuit of claim 20 wherein the low pass filter circuit comprises a resistor coupled between the first common control terminal and the first gate terminal of the first MOS transistor; and a capacitor coupled between the first common control terminal and a reference voltage.

22. The circuit of claim 16 further comprising a bypass capacitor coupled between the output node and the third conduction terminal.

* * * * *